US005525572A

United States Patent [19]

Williams

[11] Patent Number: 5,525,572

[45] Date of Patent: Jun. 11, 1996

[54] COATED FRONT FOR CARBONLESS COPY PAPER AND METHOD OF USE THEREOF

[75] Inventor: Rodney E. Williams, Fremont, Ohio

[73] Assignee: Moore Business Forms, Inc., Grand Island, N.Y.

[21] Appl. No.: 932,572

[22] Filed: Aug. 20, 1992

[51] Int. Cl.[6] ..... B41M 5/155

[52] U.S. Cl. ..... 503/201; 106/21 R; 106/21 C; 106/25 R; 427/150; 427/152; 503/209; 503/212; 503/214; 503/225

[58] Field of Search ..... 427/150-152; 503/207, 208, 216, 225, 201, 209, 212, 214; 106/21 R, 21 C, 25 R

[56] References Cited

U.S. PATENT DOCUMENTS

| | | | |
|---|---|---|---|
| Re. 33,172 | 2/1990 | Gruber et al. . | |
| 3,900,216 | 8/1975 | Hayashi et al. . | |
| 3,904,803 | 9/1975 | Brown et al. . | |
| 3,934,069 | 1/1976 | Atzrott et al. . | |
| 3,952,132 | 4/1976 | Kato et al. . | |
| 4,022,735 | 5/1977 | Thompson . | |
| 4,022,936 | 5/1977 | Miller et al. | 427/151 |
| 4,025,399 | 5/1977 | Matsumoto et al. . | |
| 4,121,013 | 10/1978 | Miller et al. | 428/411 |
| 4,125,675 | 11/1978 | Sekiguchi et al. . | |
| 4,166,644 | 9/1979 | Kay et al. . | |
| 4,188,456 | 2/1980 | Patel . | |
| 4,217,162 | 8/1980 | Glanz et al. . | |
| 4,221,690 | 9/1980 | Riecke et al. . | |
| 4,257,935 | 3/1981 | Sekiguchi et al. . | |
| 4,263,344 | 4/1981 | Radvan et al. . | |
| 4,284,696 | 8/1981 | Ishida et al. . | |
| 4,298,651 | 11/1981 | Tutty . | |
| 4,299,411 | 11/1981 | Brockett . | |
| 4,339,143 | 7/1982 | Yoshino et al. . | |
| 4,339,275 | 7/1982 | Tutty . | |
| 4,358,067 | 11/1982 | Kanda et al. . | |
| 4,359,238 | 11/1982 | Tsubusaki et al. . | |
| 4,382,264 | 5/1983 | Gaudioso . | |
| 4,387,913 | 6/1983 | Torii et al. . | |
| 4,463,034 | 7/1984 | Tokunaga et al. . | |
| 4,554,235 | 11/1985 | Adair et al. . | |
| 4,556,687 | 12/1985 | Maierson . | |
| 4,581,283 | 4/1986 | Tokunaga et al. . | |
| 4,596,996 | 6/1986 | Sandberg et al. . | |
| 4,614,757 | 9/1986 | Maierson . | |
| 4,686,260 | 8/1987 | Lindemann et al. . | |
| 4,695,524 | 9/1987 | Knapp et al. . | |
| 4,755,501 | 7/1988 | Chang et al. . | |
| 4,761,397 | 8/1988 | Higashi et al. . | |
| 4,762,868 | 8/1988 | Wright . | |
| 4,822,768 | 4/1989 | Ohga et al. . | |
| 4,851,384 | 7/1989 | Cooper . | |
| 4,859,550 | 8/1989 | Gruber et al. . | |
| 4,859,561 | 8/1989 | Metz et al. . | |
| 4,888,334 | 12/1989 | Ohga et al. . | |
| 4,889,877 | 12/1989 | Seitz . | |
| 4,931,422 | 6/1990 | Ishiguro et al. . | |
| 4,940,688 | 7/1990 | Sakai . | |
| 4,940,738 | 7/1990 | Seitz . | |
| 4,940,739 | 7/1990 | Seitz . | |
| 4,962,072 | 10/1990 | Cooper et al. . | |
| 5,026,590 | 6/1991 | Nakajima et al. . | |
| 5,034,298 | 7/1991 | Berkes et al. . | |
| 5,037,716 | 8/1991 | Moffat . | |
| 5,043,314 | 8/1991 | Suzuki et al. . | |
| 5,075,278 | 12/1991 | Vassiliades | 503/225 |
| 5,084,492 | 1/1992 | Pinell et al. . | |
| 5,330,959 | 7/1994 | Raby et al. | 503/201 |

FOREIGN PATENT DOCUMENTS

| | | |
|---|---|---|
| 0008161 | 2/1980 | European Pat. Off. . |

OTHER PUBLICATIONS

Dec. 12, 1994 Communication from European Patent Office.

*Primary Examiner*—B. Hamilton Hess
*Attorney, Agent, or Firm*—Finnegan, Henderson, Farabow, Garrett & Dunner

[57] ABSTRACT

An improved carbonless copy paper for use in magnetic image character recognition (MICR). Carbonless copy paper according to the present invention contains a coated front (CF) layer which contains a latex binding component. The improved carbonless copy paper of the present invention provides a more durable CF coating which when imprinted with indicia prevents sorting errors in magnetic image character recognition.

11 Claims, No Drawings

COATED FRONT FOR CARBONLESS COPY PAPER AND METHOD OF USE THEREOF

BACKGROUND OF THE INVENTION

1. Field of the Invention

The present invention relates to a CF (coated front) formulation for carbonless copy paper. The invention further relates to a coated front (CF) for carbonless copy paper for use in magnetic image character recognition (MICR) applications. More particularly, the invention relates to an improved CF formulation for carbonless copy paper for use in MICR applications, the formulation containing a zincated phenolic resin and a latex binder.

2. Description of the Prior Art

In the preparation of carbonless copy paper a layer of pressure rupturable colorless dye precursor is coated on the underside or backside of a top sheet, which layer is referred to as a coated back or (CB) layer. This top sheet is mated with a bottom sheet which contains a coating with a dye acceptor for the dye precursor, which coating is referred to as a coated front or (CF) layer. To develop a color image pressure is applied to the top sheet to rupture the microcapsules on the back thereof. This releases the microcapasule contents, a fluid containing dissolved colorless dye precursor. The released capsule contents, dye precursor with fluid, contacts the dye acceptor in the CF layer thereby developing a color image. Multiple copies may be made by the addition of intermediate sheets, referred to as (CFB), which contain both coated front layers, (CF) and coated back layers, (CB).

Prior art MICR coded carbonless copy paper provided significant problems to consumers when used with their sorting equipment. Standard CF has, as the coating adhesive, either a starch only binder system or a binder system containing insufficient latex to be useful in MICR applications. Starch lacks the flexibility and durability needed to withstand the MICR crash imprinting process.

When a standard CF is used for MICR applications, such as when MICR characters are printed onto CF checks or CF tickets using a "crash imprint" numbering head, the equipment, in common use, stresses the CF surface during the imprint process. Prior art solutions to this problem have included printing the CF coating only in those areas which will not receive MICR printing. When using a full coat standard CF product, the inked area of impact may flake loose in spots (e.g. tiny areas of specific numbers or other characters). This flaking may happen immediately during the printing process or later on during use. When voids caused by CF failure occur in the printed characters, errors take place in the end users' equipment. The magnetic image character recognition (MICR) scanner is not able to correctly classify the faulty image.

When the MICR character is on a bank check, the check may be put through a sorting process as many as 30 times or more. If the character is not clearly defined throughout the lifetime of use of the check, sorting errors occur. Sorting errors are usually corrected by hand, are time consuming and costly to the end user.

SUMMARY OF THE INVENTION

It is therefore an object of the present invention to overcome these and other difficulties encountered in the prior art.

Another object of the present invention to provide a CF formulation which has improved durability and flexibility.

A further object of the invention is to provide a carbonless copy paper which contains the improved CF formulation.

These and other objects have been achieved by the present invention which relates to a CF formulation and method of use thereof which incorporates a latex binding system to improve durability and flexibility.

To achieve the objects and in accordance with the purpose of the invention, as embodied and broadly described herein, the invention comprises a coated front (CF) formulation for carbonless copy paper which includes a pigment-image developer component comprising from 70 to 90 parts by dry weight of a dispersion of a pigment and from 10 to 30 parts by dry weight of an acidic image developer per 100 parts of said component, a binder comprising from about 4 to about 25 parts by weight of a latex binder and from 0 to 20 parts by weight of a starch binder, each per 100 parts by dry weight of the pigment-image developer component, and a pH control agent in an amount effective to provide a pH of from about 7 to about 9.

In another aspect of the present invention, there is provided a method of making carbonless copy paper for use in magnetic image character recognition (MICR) systems which comprises, applying to said carbonless copy paper a coated front formulation as described above, and said carbonless copy paper is imprinted with indicia to be read by magnetic image character recognition, Additional objects and advantages of the invention will be set forth in part in the description which follows, and in part will be obvious from the description, or may be learned by practice of the invention. The objects and advantages of the invention will be realized and attained by means of the elements and combination particularly pointed out in the appended claims.

DETAILED DESCRIPTION

The CF formulation according to the present invention includes a pigment, an acidic image developer material, a pH control agent and a binder. In the CF formulation according to the present invention, a latex binding system is used to provide a product which is suitable for MICR applications. In addition to the components listed above, the CF formulation according to the present invention may optionally contain a flow or coating control agent, a dispersing agent and a starch cross-linking agent.

The pigment for use in the present invention should provide good flow control under high shear while maintaining an absorbent surface. The pigment may be selected from those pigments materials which are readily known to the skilled artisan. Examples of such pigments include precipitated calcium carbonate (M-60), aluminum silicate (kaolin) and combinations thereof. Calcium carbonate adds to whiteness and brightness, precipated calcium carbonate has a higher binder demand than kaolin alone. Further Examples of pigments for use in the invention include calcined kaolin, ground calcium carbonate, hydrated alumina (alumina trihydrate), Halloysite ($Al_2O_3$—$3SiO_2$—$2H_2O$), Talc ($MgO$—$4SiO_2$—$H_2O$), zinc oxide, Deltaglos (a treated kaolin pigment produced by E.C.C. America, Inc.), Norplex 604 (chemically structured kaolin produced by Nord Kaolin company), Exsilon (chemically modified kaolin produced by Engelhard Corp.) and titanium dioxide.

The acidic image developer material may be any type of color developer which is water dispersible and serves as an acidic image former, i.e. electron acceptor, producing a color when in combination with a dye precursor. Preferred are phenolic resins and zinc salicylate.

One preferred phenolic resin for use in the present invention is a zincated alkylphenol novolac resin which can be obtained under the tradename HRJ-2456 from Schenectady Chemicals, Inc. Standard novolac resins or zinc treated novolac resins may also be used. In addition, resins treated with other appropriate cations to enhance reactivity may also be used. Examples of zinc treated novolac resins and other metal cations which can be used to enhance the reactivity of novolac resins are disclosed, for example, in U.S. Patent No. 3,723,156.

Thus, the color producing functionality of the phenolic resin is greatly improved when it is present either in conjunction with a metal, e.g. zinc salt or in a form which is actually reacted with a metal, e.g. zinc compound, in order to produce e.g., a zincated resin. While zinc is the preferred cation, other metal cations may also be used, such as cadmium (III), zirconium (II), cobalt (II), strontium (II), aluminum (III), copper (III), and tin (II).

All amounts for the CF formulation according to the present invention are given based upon 100 parts (dry weight basis) of the pigment-image developer component of the formulation. This portion of the formulation is made up of the pigment and the image developer material. Dry pigments make up from 70% to 90% of this component, preferably from 80% to 87%. The remainder is the image developer material.

The pH control agent for use in the present invention is selected from those which are readily recognizable to the skilled artisan. Examples of such pH control agents include ammonium, potassium and sodium hydroxide. The pH control agent is added in an amount to provide a pH from about 7 to about 9.

In addition to or in the place of the starch binding component in the standard CF formulations, the present invention adds a latex binding component which improves durability and flexibility of the coating making carbonless copy paper able to withstand the crash imprinting process of MICR.

The latex binder may be selected from styrenebutadiene latexes, carboxylated styrenebutadiene latexes, acrylic latexes, acrylonitrile latexes and polyvinyl acetate. Additional latexes for use in the invention are readily recognizable to the skilled artisan. These latex binders may be purchased under the tradenames DOW 620 from Dow Chemical U.S.A.; GENFLO 5092, GENFLO 5086 and GENFLO 5100 from Gen Corp. Polymer Products; HU 1003 from Nippon Zeon Co., Ltd.; RP LG 19121 and RP LG 19232 from Rhone Poulenc Paper Chemicals. The binder may be made up of one or more of the latexes discussed above in combination, alone, or with a starch component. The latex binder is present in from about 4 to 25 parts per 100 parts of the dry material, more preferably, the latex binder is present in from about 6 to about 10 parts. Starch for use in the present invention can be obtained under the tradename PG-380, a hydroxyethylated corn starch produced by Penford Products. Starch can be present from about 0 to 20 parts per 100 parts of dry material, more preferably from about 5 to 20 parts. In addition to or in lieu of the latex and starch described above, the binder may be composed of a starch/styrenebutadiene copolymer such as Pengloss 115, produced by Penford Products.

In addition to the components listed above, the CF composition according to the present invention may further include a flow or coating control agent, a starch cross-linking agent, a dispersing agent and a biocide. The flow control agent for use in the present invention, which may be in addition to or in lieu of the starch component of the binder, is selected from starch, hydroxyethyl cellulose, carboxymethyl cellulose, polyvinyl alcohol, casein or protein derived material, synthetic polymers such as maleic anhydride-styrene copolymer produced by Monsanto under the tradename SCRIPSET, sodium alginate, gum arabic or combinations thereof. In addition, thickening agents such as those manufactured by Rhom and Haas of polyacrylic acids and sodium, potassium and ammonium salts thereof under the tradename ACRYSOL are effective flow modifiers that may be used in the present invention. The amount of flow or coating control agent to be added depends upon the particular agent or agents chosen and the binder used. Often when changing flow control agents and/or binders, the addition amount of each components must be modified. One having ordinary skill in the art would be capable of optimizing the addition amounts of these components.

Dispersing agents for use in the present invention are selected from those which are readily recognizable to the skilled artisan. Examples of such dispersing agents include sodium polyacrylate copolymer solutions e.g. Colloid 230 produced by Rhone-Poulenc; the Daxad series manufactured by W. R. Grace Co. including sodium polyisobutylene maleic anhydride copolymer, salts of napthalene sulfonic acid condensates, polymethacrylic acids and sodium and ammonium salts thereof, and polyacylate and sodium and ammonium salts thereof; and, Tamols manufactured by Rhom and Haas Co. including, Tamol L, which is sodium salt of condensed napthalene sulfonic acid, Tamol 850 and 731 which are methacrylic polymers. Additional dispersing agents for use in the invention are described in Robert D. Athey, Jr. "Polymeric Organic Dispersants for Pigments: useful structures and their evaluations" Tappi, Vol. 58, No. 10, October 1975, which is herein incorporated by reference.

When starch is present in the binder component, a starch cross-linking agent may be added. The starch cross-linking agent for use in the present invention is selected from those which are readily recognizable to the skilled artisan. Examples of such starch cross-linking agents include HTI Insolubilizer 5550 produced by Hopton Technologies, Inc and Sunrez 700M, a substituted pyrimidone glyoxal polymer obtained from Sequa Chemicals, Inc. The starch cross-linking agent is added in from about 2% to about 4% based upon the amount of dry starch solids present.

The biocide for use in the present invention is selected from those which are readily recognizable to the skilled artisan to prevent degradation of the naturally occurring components. Examples of such biocides include Nalco 7649 produced by Nalco Corp.

The CF formulation is then applied to a substrate, for example paper or paperboard. Once the CF coating has been applied, the coated substrates are ready to have indicia capable of recognition by MICR imprinted thereon. The printing process does not damage the CF coating thus providing a secure and long lasting printed article.

The following examples are illustrative of the invention embodied herein.

EXAMPLE 1

The MICR formulation for the CF layer was formed by combining the following ingredients:

| | |
|---|---|
| Pigments (Exsilon) | 85 lbs dry weight |
| Phenolic resin | 15 lbs dry weight |
| active parts Colloid 230 | 1.5 lbs dry weight |
| Ammonia | pH 8–9 |
| PG 380 Starch | 12 lbs dry weight |
| Dow 620 latex | 8 lbs dry weight |

EXAMPLE 2

The MICR formulation for the CF layer was formed by combining the following ingredients:

| | |
|---|---|
| Pigments | 85 lbs dry weight |
| Exsilon | 55 lbs dry weight |
| M-60 Calcium carbonate | 30 lbs dry weight |
| Phenolic resin | 15 lbs dry weight |
| active parts Colloid 230 | 1.5 lbs dry weight |
| Ammonia | pH 8–9 |
| PG 380 Starch | 12 lbs dry weight |
| Dow 620 latex | 8 lbs dry weight |
| HTI Insolubilizer 5550 | 0.48 lbs dry weight |

EXAMPLE 3

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 163.00 | 63.0% |
| M-60 CALCIUM CARBONATE | 30.15 | 43.07 | 80.42 | 70.0% |
| WATER | | 34.85 | 65.08 | |
| COLLOID 230 | 1.50 | 3.45 | 6.44 | |
| AMMONIA 28 | | 0.80 | 1.12 | |
| HRJ-2456 (PHENOLIC RESIN) | 16.39 | 30.93 | 57.74 | |
| PG-380 STARCH | 12.00 | 40.00 | 74.88 | 30.0% |
| DOW 620 | 8.00 | 18.00 | 29.87 | 50.0% |
| NALCO 7649 | | 0.08 | 0.16 | |
| SUNREZ 700M | 0.36 | 0.80 | 1.49 | |
| | 123.40 | 267.08 | 480.00 | |
| | % = | 48.00 | | |

EXAMPLE 4

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 156.65 | 63.0% |
| M-60 CALCIUM CARBONATE | 30.15 | 43.07 | 77.28 | 70.0% |
| WATER | | 31.90 | 57.24 | |
| COLLOID 230 | 1.50 | 3.45 | 8.19 | |
| AMMONIA 26 | | 0.60 | 1.08 | |
| HRJ-2456 (PHENOLIC RESIN) | 16.39 | 30.83 | 55.50 | |
| SOLVENT CAPSULES | 5.00 | 13.37 | 23.99 | |
| PG-380 STARCH | 12.00 | 40.00 | 71.77 | |
| DOW 620 LATEX | 8.00 | 16.00 | 28.71 | 50.0% |
| NALCO 7649 | | 0.08 | 0.16 | |
| SUNREZ 700M | 0.36 | 0.80 | 1.44 | |
| | 128.40 | 267.50 | 480.00 | |
| | % = | 48.00 | | |

EXAMPLE 5

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 150.78 | 63.0% |
| M-60 CALCIUM CARBONATE | 30.15 | 43.07 | 74.39 | 70.0% |
| WATER | | 28.95 | 60.00 | |
| COLLOID 230 | 1.50 | 3.45 | 0.90 | |
| AMMONIA 26 | | 0.60 | 1.04 | |
| HRJ-2456 (PHENOLIC RESIN) | 18.39 | 30.93 | 53.42 | |
| SOLVENT CAPSULES | 10.00 | 26.74 | 46.18 | |
| PG-380 STARCH | 12.00 | 40.00 | 69.08 | |
| DOW 620 LATEX | 8.00 | 16.00 | 27.83 | 50.0% |
| NALCO 7649 | | 0.08 | 0.14 | |
| SUNREZ 700M | 0.36 | 0.80 | 1.38 | |
| | 133.40 | 277.92 | 480.00 | |
| | % = | 48.00 | | |

SOLVENT CAPSULES: Polyurea solvent capsules

EXAMPLE 6

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 145.33 | 63.0% |
| M-60 CALCIUM CARBONATE | 30.15 | 43.07 | 71.70 | 70.0% |
| WATER | | 28.00 | 43.28 | |
| COLLOID 230 | 1.50 | 3.45 | 6.74 | |
| AMMONIA 26 | | 0.60 | 1.00 | |
| HRJ-2456 (PHENOLIC RESIN) | 16.39 | 30.93 | 51.49 | |
| SOLVENT CAPSULES | 15.00 | 40.11 | 66.71 | |
| PG-380 STARCH | 12.00 | 40.00 | 66.59 | |
| DOW 620 LATEX | 8.00 | 16.00 | 28.64 | 50.0% |
| NALCO 7649 | | 0.06 | 0.14 | |
| SUNREZ 700 M | 0.36 | 0.80 | 1.33 | |
| | 138.40 | 288.34 | 480.00 | |
| | % = | 48.00 | | |

EXAMPLE 7

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 174.30 | 63.0% |
| M-60 CALCIUM CARBONATE | 30.15 | 43.07 | 85.99 | 70.0% |
| WATER | | 34.19 | 88.26 | |
| COLLOID 230 | 1.50 | 3.45 | 6.88 | |

-continued

| "55/30" BASIC M | MATERIAL BALANCE | | Lab size | |
|---|---|---|---|---|
| MATERIAL | DRY Wgt | WET Wgt | ½ pint | |
| AMMONIA 26 | | 0.60 | 1.20 | |
| HRJ-2456 (PHENOLIC RESIN) | 16.39 | 30.93 | 6.175 | |
| PG-380 STARCH | 12.00 | 40.00 | 79.86 | 30.0% |
| NALCO 7649 | | 0.08 | 0.17 | |
| SUNREZ 700M | 0.36 | 0.80 | 1.60 | |
| | 155.40 | 240.42 | | |
| | % = | 48.00 | | |

EXAMPLE 8

The MICR formulation for the CF layer was formed by combining the following ingredients:

| "55/30" BASIC | MATERIAL BALANCE | | Lab size |
|---|---|---|---|
| MATERIAL | DRY Wgt | WET Wgt | ½ pint |
| EXSILON | 85.00 | 87.30 | 177.47 |
| M-60 CALCIUM CARBONATE | 30.15 | 43.07 | 87.56 |
| WATER | | 60.03 | 101.70 |
| COLLOID 230 | 1.50 | 3.45 | 7.01 |
| AMMONIA 26 | | 0.60 | 1.22 |
| HRJ-2456 (PHENOLIC RESIN) | 16.39 | 30.93 | 62.87 |
| DOW 620 LATEX | 10.00 | 20.00 | 40.68 |
| NALCO 7649 | | 0.08 | 0.17 |
| | 113.04 | 235.46 | 478.68 |
| | % = | 48.00 | |

EXAMPLE 9

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 169.75 | 63.0% |
| M-60 CALCIUM CARBONATE | 30.15 | 43.07 | 83.75 | 70.0% |
| WATER | | 60.49 | 00.05 | |
| COLLOID 230 | 1.60 | 3.45 | 6.70 | |
| AMMONIA 26 | | 0.60 | 1.17 | |
| HRJ-2456 (PHENOLIC RESIN) | 16.39 | 30.93 | 60.14 | |
| DOW 620 LATEX | 15.00 | 30.00 | 68.33 | 50.0% |
| NALCO 7649 | | 0.08 | 0.16 | |
| | 118.04 | 245.86 | | |
| | % = | 48.00 | | |

EXAMPLE 10

The MICR formulation for the CF layer was formed by combining the following ingredients:

| "55/30" BASIC M | MATERIAL BALANCE | | Lab size |
|---|---|---|---|
| MATERIAL | DRY Wgt | WET Wgt | ½ pint |
| EXSILON | 55.00 | 87.30 | 162.68 |
| M-60 CALCIUM CARBONATE | 30.15 | 43.07 | 80.26 |
| WATER | | 50.82 | 94.70 |
| COLLOID 230 | 1.60 | 3.45 | 6.43 |
| AMMONIA 26 | | 0.60 | 1.12 |
| HRJ-2456 (PHENOLIC RESIN) | 16.39 | 30.83 | 67.83 |
| DOW 620 LATEX | 20.00 | 40.00 | 74.54 |
| NALCO 7649 | | 0.08 | 0.16 |
| SUNREZ 700M | 0.60 | 1.33 | 2.48 |
| | 123.04 | 256.26 | 477.52 |
| | % = | 48.00 | |

EXAMPLE 11

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.80 | 174.30 | 63.0% |
| M-60 CALCIUM CARBONATE | 30.15 | 43.07 | 85.99 | 70.0% |
| WATER | | 34.19 | 68.26 | |
| COLLOID 230 | 1.50 | 3.45 | 6.88 | |
| AMMONIA 20 | | 0.00 | 1.20 | |
| HRJ-2456 (PHENOLIC RESIN) | 16.39 | 30.93 | 61.75 | |
| PG-380 STARCH | 12.00 | 40.00 | 79.86 | 30.0% |
| NALCO 7649 | | 0.08 | 0.17 | |
| SUNREZ 700M | 0.36 | 0.80 | 1.60 | |
| | 115.40 | 240.42 | 480.00 | |
| | % = | 48.00 | | |

EXAMPLE 12

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.80 | 177.47 | 63.0% |
| M-60 CALCIUM CARBONATE | 30.15 | 43.07 | 87.58 | 70.0% |
| WATER | | 50.03 | 101.70 | |
| COLLOID 230 | 1.50 | 3.45 | 7.01 | |
| AMMONIA 20 | | 0.00 | 1.22 | |
| HRJ-2456 (PHENOLIC RESIN) | 16.39 | 30.93 | 62.87 | |
| PENGLOS, 50% | 10.00 | 20.00 | 40.66 | 50.0% |
| NALCO 7649 | | 0.08 | 0.17 | |
| SUNREZ 700M | 0.30 | 0.67 | 1.36 | |
| | 113.34 | 236.13 | 480.00 | |
| | % = | 48.00 | | |

EXAMPLE 13

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 66.00 | 97.30 | 180.75 | 83.0% |
| M-60 CALCIUM CARBONATE | 30.15 | 43.07 | 83.76 | 70.0% |
| WATER | | 50.43 | 98.05 | |
| COLLOID 230 | 1.50 | 3.45 | 6.70 | |
| AMMONIA 26 | | 0.60 | 1.17 | |
| HRJ-2456 (PHENOLIC RESIN) | 16.39 | 30.93 | 60.14 | |
| PENGLOS, 50% | 15.00 | 30.00 | 58.33 | 50.0% |
| NALCO 7649 | | 0.08 | 0.18 | |
| SUNREZ 700M | 0.45 | 1.00 | 1.94 | |
| | 118.49 | 246.86 | 480.00 | |
| | % = | 48.00 | | |

EXAMPLE 14

The MICR formulation for the CF layer was formed by combining the following ingredients:

| "55/30" BASIC M | MATERIAL BALANCE | | Lab size | |
|---|---|---|---|---|
| MATERIAL | DRY Wgt | WET Wgt | ½ pint | |
| EXSILON | 55.00 | 87.30 | 162.68 | 83.0% |
| M-60 CALCIUM CARBONATE | 30.16 | 43.07 | 80.28 | 70.0% |
| WATER | | 50.82 | 94.70 | |
| COLLOID 230 | 1.50 | 3.45 | 6.43 | |
| AMMONIA 26 | | 0.60 | 1.12 | |
| HRJ-2456 (PHENOLIC RESIN) | 16.39 | 30.93 | 57.83 | |
| PENGLOS, 50% | 20.00 | 40.00 | 74.54 | 50.0% |
| NALCO 7649 | | 0.08 | 0.16 | |
| SUNREZ 700M | 0.60 | 1.33 | 2.48 | |
| | 123.64 | 257.59 | 480.00 | |
| | % = | 48.00 | | |

Other embodiments of the invention will be apparent to those skilled in the art from consideration of the specification and practice of the invention disclosed herein. It is intended that the specification and examples be considered as exemplary only with a true scope and spirit of the invention being indicated by the following claims.

What is claimed is:

1. A coated front (CF) formulation for carbonless copy paper which comprises:

a pigment-image developer component comprising from 70 to 90 parts by dry weight of a dispersion of a pigment and from 10 to 30 parts by dry weight of an acidic image developer, a binder comprising from about 4 to about 25 parts by weight of a latex binder and from 0 to 20 parts by weight of a starch binder, each per 100 parts by dry weight of the pigment-image developer component, and a pH control agent in an amount effective to provide a pH of from about 7 to about 9.

2. A method of making carbonless copy paper for use in magnetic image character recognition (MICR) systems comprising, applying to carbonless copy paper a coated front formulation comprising, a pigment-image developer component comprising from 70 to 90 parts by dry weight of a dispersion of a pigment and from 10 to 30 parts by dry weight of an acidic image developer, a binder comprising from about 4 to about 25 parts by weight of a latex binder and from 0 to 20 parts by weight of a starch binder, each per 100 parts by dry weight of the pigment-image developer component, and a pH control agent in an amount effective to provide a pH of from about 7 to about 9, imprinting said carbonless copy paper with indicia to be read by magnetic image character recognition.

3. The method according to claim 2, wherein the latex binder is carboxylated styrenebutadiene.

4. The method according to claim 2, wherein said acidic image developer is a phenolic resin.

5. The method according to claim 4, wherein said phenolic resin component is a zincated phenolic resin.

6. The method according to claim 2, wherein said coated front formulation further comprises a flow or coating control agent.

7. The method according to claim 6, wherein said flow or coating control agent is starch.

8. The method according to claim 2, wherein said binder comprises from about 5 to about 20 parts of starch.

9. The method according to claim 8, wherein said coated front formulation further comprises a starch cross-linking agent.

10. The method according to claim 2, wherein said coated front formulation further comprises a dispersing agent.

11. The method according to claim 10, wherein said dispersing agent is a sodium polyacrylate copolymer.

* * * * *